United States Patent [19]

Mangla

[11] Patent Number: 4,625,907

[45] Date of Patent: Dec. 2, 1986

[54] THERMOFORMING EIGHTEEN-CELL HINGED COVER CARTON FROM PLASTIC SHEET

[75] Inventor: Raj K. Mangla, East Rochester, N.Y.

[73] Assignee: Mobil Oil Corporation, New York, N.Y.

[21] Appl. No.: 700,849

[22] Filed: Feb. 11, 1985

Related U.S. Application Data

[62] Division of Ser. No. 481,512, Apr. 1, 1983, abandoned.

[51] Int. Cl.[4] ..... B65D 43/22; B29C 51/08; B29C 51/32; B29C 55/02

[52] U.S. Cl. ..... 229/45 EC; 229/2.5 EC; 229/44 EC; 264/155; 264/156; 264/321; 425/291; 425/398; 425/817 R

[58] Field of Search ..... 264/321, 155, 156; 229/44 EC, 45 EC, 2.5 EC; 425/291, 398, 817 R

[56] References Cited

U.S. PATENT DOCUMENTS

| | | | |
|---|---|---|---|
| 3,968,921 | 7/1976 | Jewell | 229/45 R X |
| 4,143,111 | 3/1979 | Irwin | 264/321 X |
| 4,304,747 | 12/1981 | Lake | 264/321 X |
| 4,419,068 | 12/1983 | Congleton | 264/321 X |
| 4,463,894 | 8/1984 | Daines | 229/45 EC X |

*Primary Examiner*—Philip Anderson
*Attorney, Agent, or Firm*—Alexander J. McKillop; Michael G. Gilman; Charles J. Speciale

[57] ABSTRACT

An egg carton thermoformed from a plastic sheet has a cover extension and a cell section extension formed by stretching the plastic sheet in the opposite direction from the sheet line from the direction in which the cover and the cell section are formed. Latching elements on these extensions lock the egg carton without the need for a latch flap. This permits the eighteen cell carton to be loaded on conventional egg loading machinery. The mold for forming the carton has formers which mate with cavities to stretch the plastic into the cover and cell section extensions.

6 Claims, 18 Drawing Figures

THERMOFORMING EIGHTEEN-CELL HINGED COVER CARTON FROM PLASTIC SHEET

This is a divisional of copending application Ser. No. 481,512, filed on Apr. 1, 1983 and now abandoned.

BACKGROUND OF THE INVENTION

This invention relates to an improved egg carton, and to methods of making it.

U.S. Pat. No. 2,990,094 shows an egg carton with a latch of the type in which a "button" on the latch flap extends through a hole in the flat surface of the cover to latch the carton closed. Problems were experienced with this type of egg carton because persons picking the carton up by the cover inadvertently pushed the protrusion out of engagement with the hole, thereby unlatching the egg carton with disastrous results.

Cartons of the type shown in U.S. Pat. No. 3,648,916—Commisso obviate this problem. The latch flap has a locking recess which includes a latch bar across the top thereof. The cover has recesses which are complementary to the recess on the latch flap. A hole is cut across the recess in the cover. This hole extends from the flat surface of the front of the cover down into the recess, across the recess, and back to the front surface of the cover. In the closed position, the latching bar fits into this hole to hold the cover in the closed position. This latching mechanism has the advantage that it is recessed. Therefore, when the carton is grasped by the cover, there is no possibility of inadvertently unlatching the cover.

Egg cartons of the type shown in the Commisso patent have been successfully used for packaging a dozen eggs. The cartons are easily produced in large quantities by thermoforming a sheet of preheated polystyrene foam.

An egg carton fabrication technique which preceded that of thermoforming is the molding of cartons from pulp. In such a process, semi-liquid pulp is sprayed or otherwise inserted into a mold having the desired configuration. U.S. Pat. No. 3,215,327—Crabtree shows an example of a molded pulp carton. Pulp cartons have been extensively and successfully used. However, the recent trend has been toward thermoformed plastic cartons because of improved appearance and economies of production over molded pulp cartons.

In some markets, eggs are sold in cartons of eighteen eggs, rather than in the traditional "dozen" carton. Heretofore, eighteen cell egg cartons have been thermoformed from plastic sheet only in a version which does not have a protective cover. An eighteen cell carton with protective cover has been produced in molded pulp. It is desirable to thermoform an eighteen cell egg carton with a protective cover which can be latched to the cell section when the carton is closed. However, the existing covered eighteen cell cartons such as the pulp carton presently on the market, cannot be thermoformed from plastic sheet. For one reason, the latch of such a carton has long elements, which, if thermoformed, would entail a severe extension beyond the sheet line. In thermoforming, extensions beyond the sheet line are undesirable because severe extensions produce weakened plastic elements.

Furthermore, existing thermoformed cartons, such as that shown in the Commisso patent, cannot be simply expanded to accommodate eighteen eggs. One of the requirements for egg cartons is that they be suitable for use in existing packaging equipment. A large amount of packaging equipment has already been placed in the field for packaging eggs. This packaging equipment accepts both covered twelve cell and coverless eighteen cell egg cartons. Alternatively, this same equipment has been used to process the covered pulp cartons which have a cell section which is 6" by 12" and a cover which is 6" by 12". The reason that thermoformed cartons, such as that shown in the Commisso patent, cannot be expanded to an eighteen cell configuration is that such cartons have a latch flap. Eighteen cell cartons with a latch flap cannot be processed on existing standard packaging equipment. Standard packaging equipment has an egg carton holder that will not accept a carton any larger than 12" by 12" in the open position. To be processed on existing equipment, cartons must have overall dimensions no greater than 12"×12" when in the open position.

It is an object of the present invention to provide an egg carton with an eighteen cell configuration which can be thermoformed from a plastic sheet and which can be processed on existing packaging equipment.

RELATED APPLICATIONS

Co-pending application Ser. No. 299,683, filed Sept. 8, 1981, Daines entitled "Method and Mold For Making an Improved Egg Carton", shows the cutting of a latching hole in the cover during the molding of a twelve cell egg carton.

SUMMARY OF THE INVENTION

In accordance with the present invention, an egg carton is thermoformed from a plastic sheet with the front of the cover having an extension which is stretched above the sheet line and with the cell section having an extension which is stretched above the sheet line. By stretching both the cover and the cell section above the sheet line, complementary elements of a latch can be formed in the cover and the cell section. This latch is formed without severe stretching of the plastic which would produce weakened latch elements in prior art egg carton designs. Moreover, since the carton is formed without a latch flap, these cartons have covers and cell sections with equal dimensions. In the opened condition, the cartons have dimensions such that they can be processed on existing packaging equipment.

In making the cartons, male and female mold members are closed on a preheated sheet of polystyrene plastic. The cell sections and the dished cover are formed by extending the plastic in one direction away from the sheet line. The extensions on the cover and the cell section are formed by stretching the plastic in the opposite direction away from the sheet line. Normally, it is desirable to avoid such a stretching operation during thermoforming because it produces a weakened plastic part. However, I have found that by stretching both the cover and the cell section slightly, extensions can be produced having sufficient rigidity to form the complementary elements of a latch.

The foregoing and other objects, features and advantages of the invention will be better understood from the following more detailed description and appended claims.

SHORT DESCRIPTION OF THE DRAWINGS

DESCRIPTION OF THE PREFERRED EMBODIMENT

Figure 1:
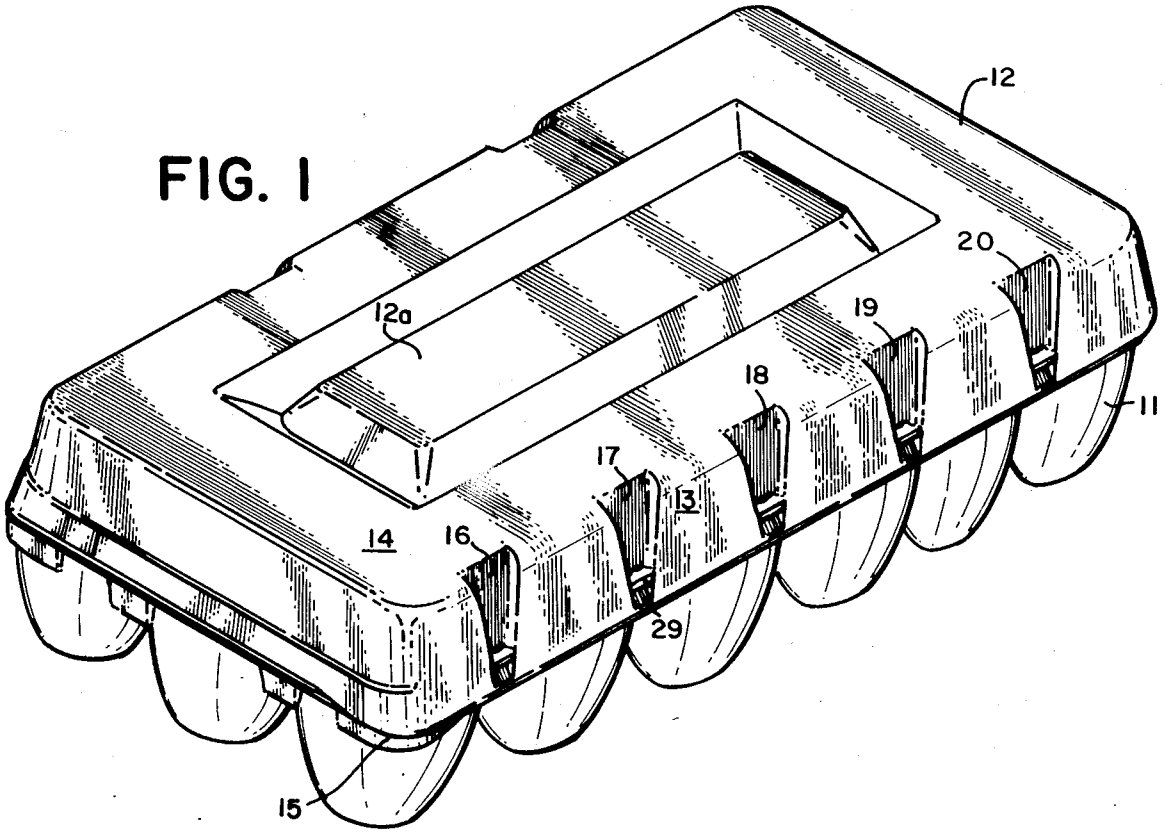
FIG. 1 is perspective view of the egg carton of the present invention in its closed condition.

The egg carton of the present invention includes a cell section 11 formed to define cells for receiving eighteen eggs. A dished cover 12 is resiliently hinged to the rear upper edge of the cell section. It has a front wall 13, a top 14, a back wall, and end walls fixed to the top. The front wall 13 slopes in a plane inwardly toward the top. Cover 12 has a rectangular post 12*a* which helps maintain the eggs in position in the cell sectoin. Front wall 13 has a cover extension 15 which is stretched beyond the end walls of the cover.

Figure 2:
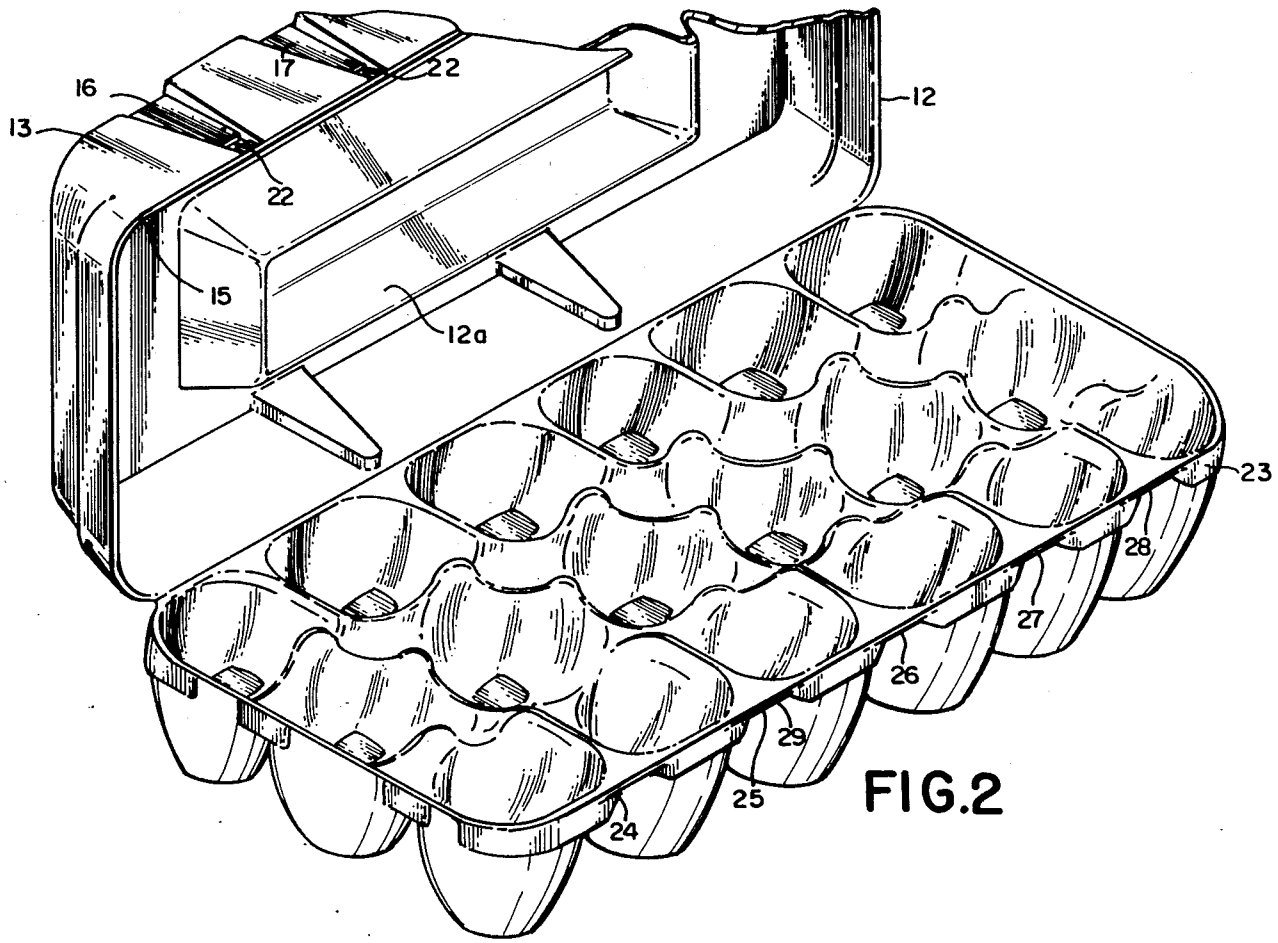
FIG. 2 is a perspective view of the egg carton of the present invention in its open condition.

Flutes 16–20 in the front wall of the cover each have a surface which is inwardly offset with respect to the front wall. A hole such as 22 (FIG. 2) in this surface is cut in a plane which is transverse to the top 14 of the cover.

Figure 3:
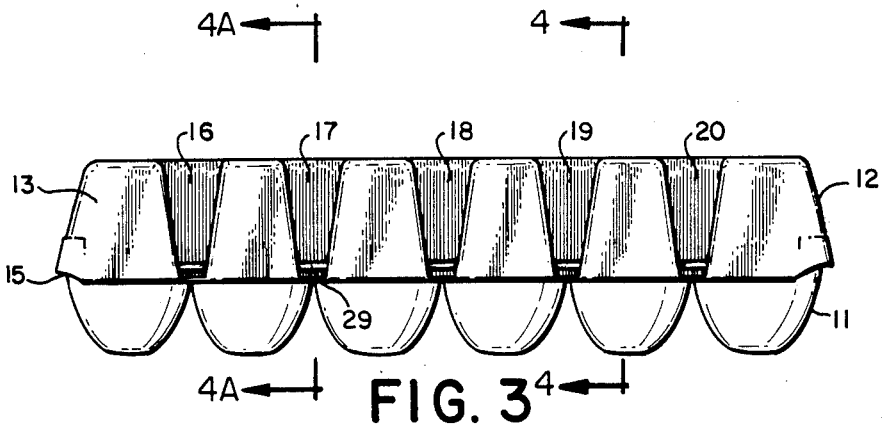
FIG. 3 is a front view of the egg carton.
Figure 6:
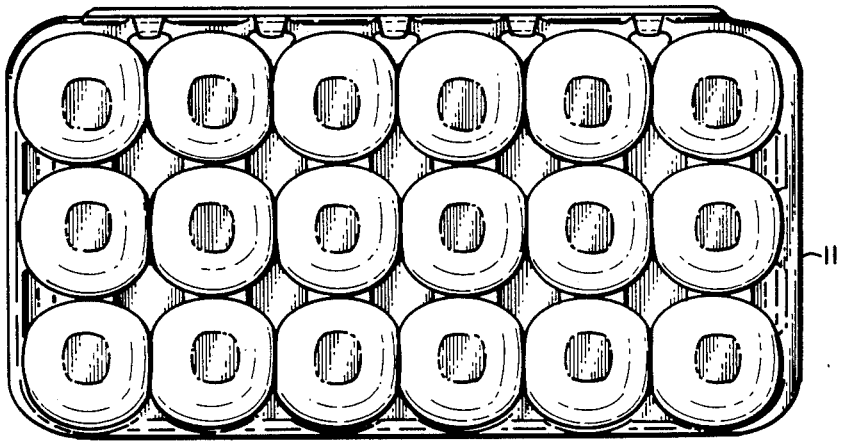
FIG. 6 is a top view of the cell section.
Figure 7:
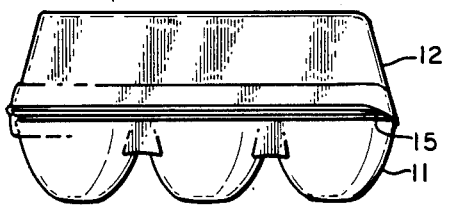
FIG. 7 is an end view of the carton.
Figure 4:
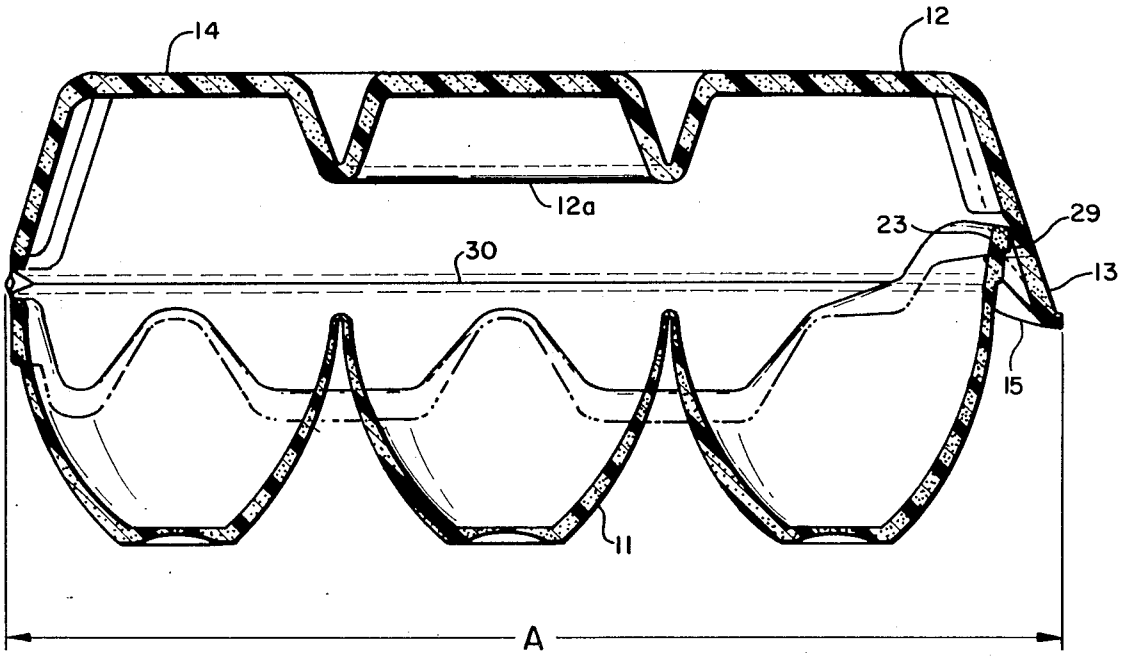
FIG. 4 is a section of the line 4—4 of FIG. 3.
Figure 4A:
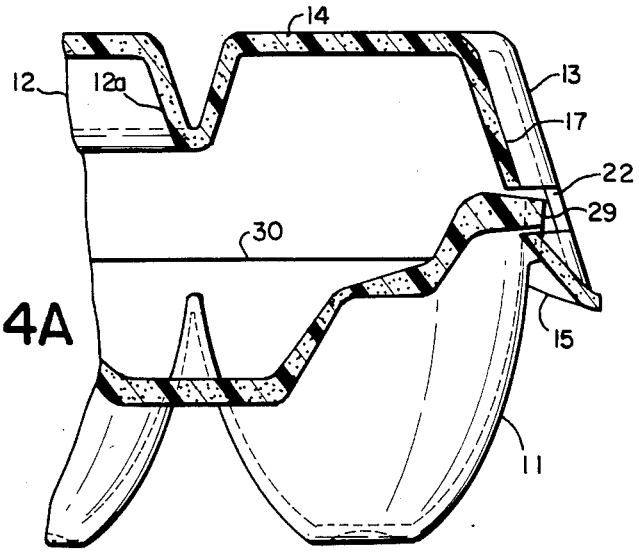
FIGS. 4A-4C show further details of the latch structure.
Figure 4B:
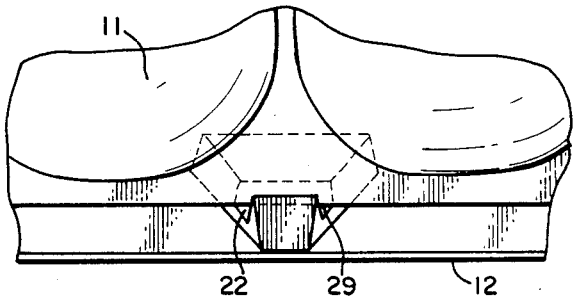
Figure 4C:
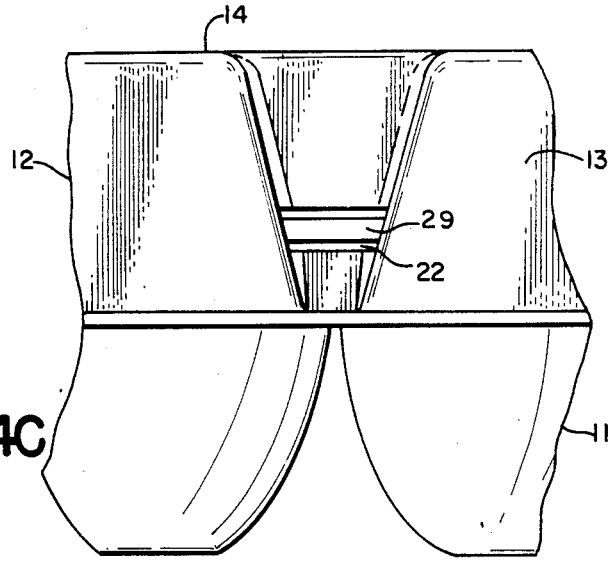

Cell section 11 has an extension 23 stretched beyond the walls of the cell section. Latching areas 24–28 in the cell section extension complement the flutes 16–20 in the front wall of the cover. Latching elements, which may be latch bars, or protrusions, such as 29, extend through the complementary hole, such as 22, in the inwardly offset surface of the cover. This latches the carton when it is in the closed position as shown in FIGS. 3 and 4. The carton of the present invention has the advantage that when in the closed position, the latching element, such as protrusion 29 is within the confines of the recess 17 so that it cannot be inadvertently unlatched by grasping the cover of the carton.

Figure 5:
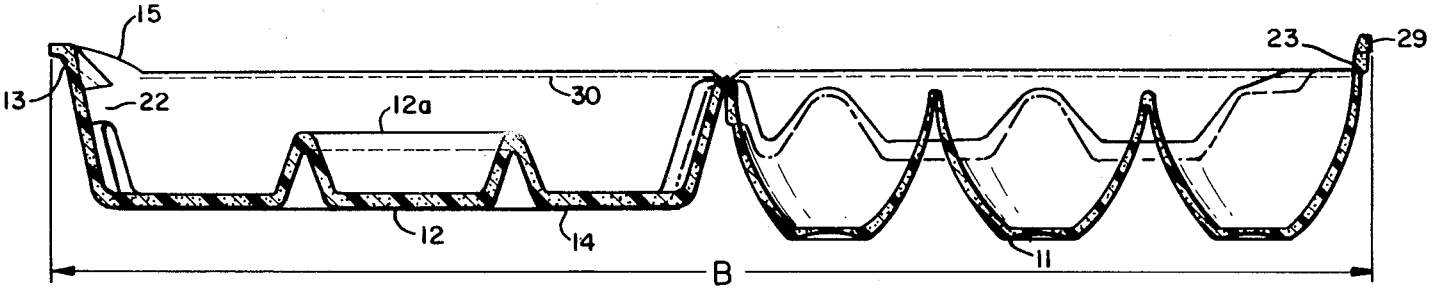
FIG. 5 is a cross-section through the carton in its open condition.

FIG. 5 shows the carton in relation to the sheet line 30. During the molding operation, male and female mold members are closed to form the cell section from the sheet, which originally extends along the line 30. As shown in FIG. 5, the cell section 11 and the cover 12 extend below the sheet line 30. During the molding, the plastic sheet is stretched in the opposite direction to form the cover extension 13 and the cell section extension 23. As shown in FIG. 5, the plastic is stretched in the opposite direction, in this case, upwardly from the sheet line 30, to form these extensions.

Figure 8A:
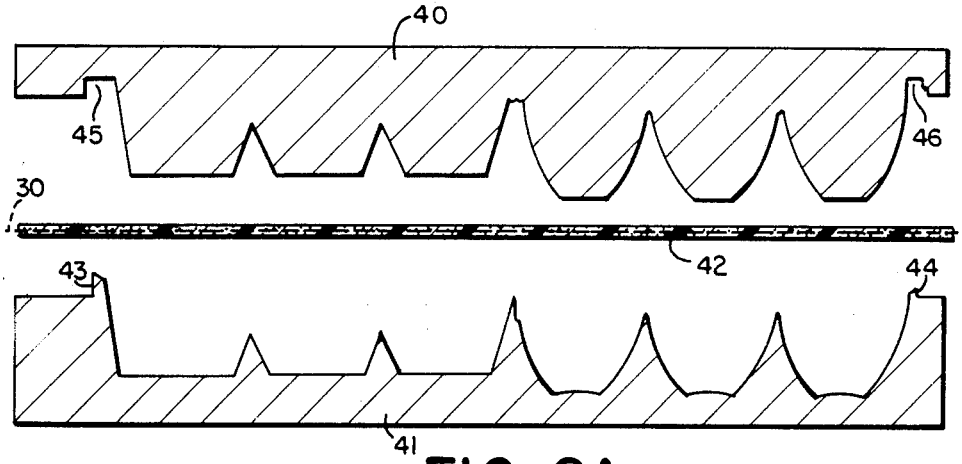
FIGS. 8A-8C depict the process of molding the egg carton.
Figure 8B:
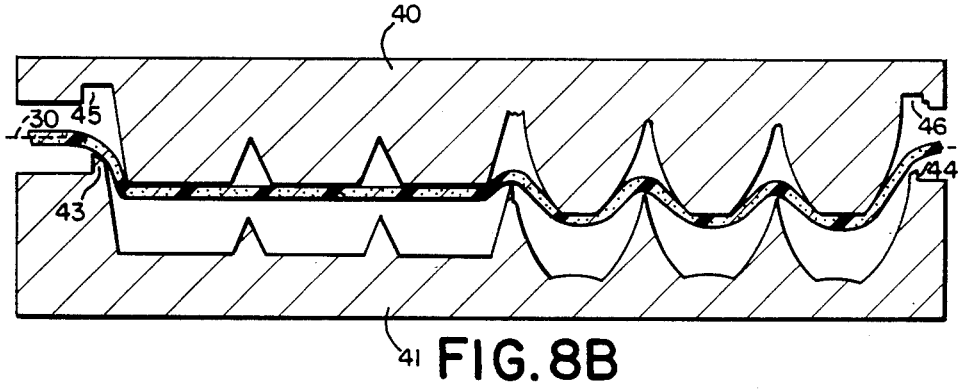
Figure 8C:
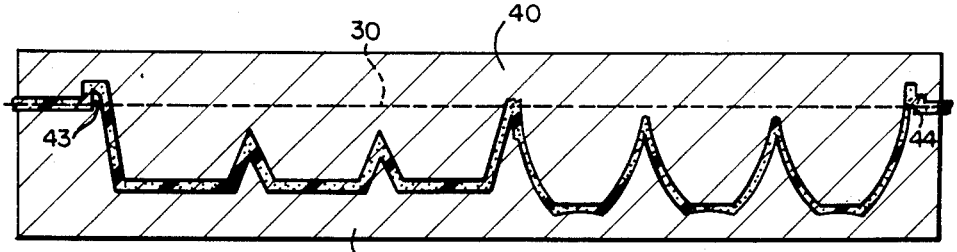

FIGS. 8A–8C depict the process of molding the egg carton. FIG. 8A shows a male mold member 40 and female mold member 41 open with a foam sheet 42 flat between them. FIG. 8B shows the mold members closing to form the cover and cell sections extending in one direction from the sheet line 30. FIG. 8C shows further closing of the mold to stretch the plastic over the formers 43 and 44 to form the extensions. Cavities 45 and 46 in the male mold member 40 stretch the plastic over formers 43 and 44. Male and female cutting keys in the mold members cut the holes in the cover while molding as described in the aforementioned Daines application.

Figure 9C:
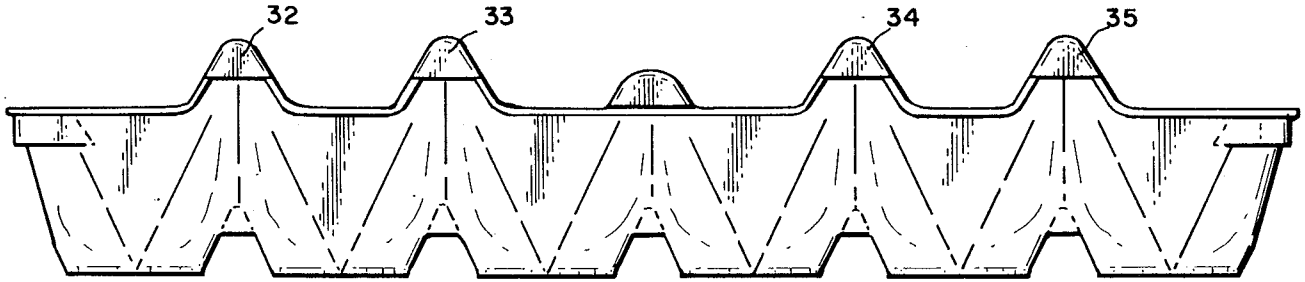
PRIOR ART FIG. 9C
FIGS. 9A-9C show a prior art eighteen cell molded pulp egg carton with a hinged lid.
Figure 9A:
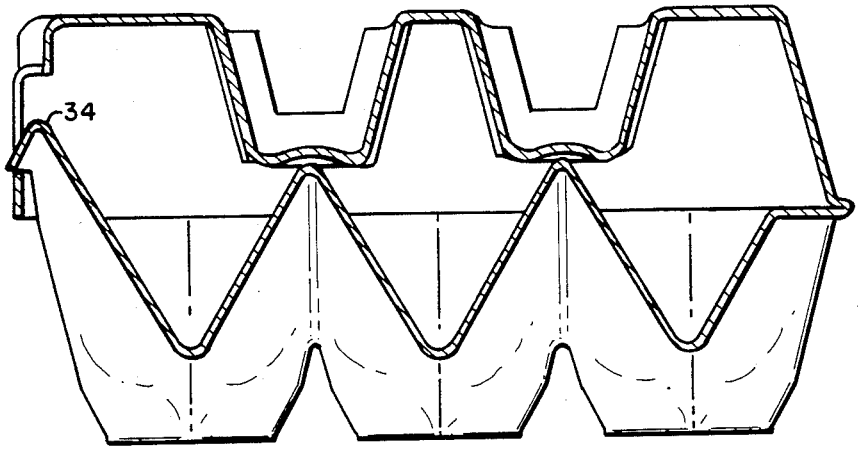
PRIOR ART FIG. 9A
Figure 9B:
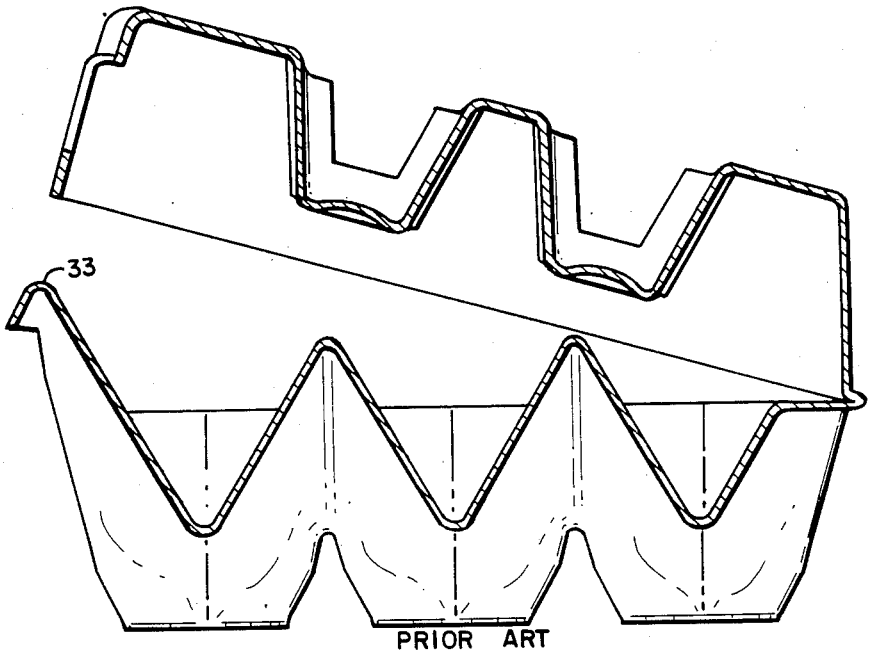
PRIOR ART FIG. 9B

The advantages of applicant's invention can be better understood by comparing it with FIGS. 9A–C and 10. FIGS. 9A–9C depict the prior art pulp carton with a hinged cover which has been successfully filled in existing packaging machinery. This pulp carton includes protrusions 32–35 on the cell section. These protrusions have hooks which mate with holes in the cover to latch the carton. The protrusions on the cell section are such long extensions from the body of the carton that they cannot be economically and reliably made by thermoforming. To stretch plastic so far above the sheet line would not produce good results.

Figure 10A:
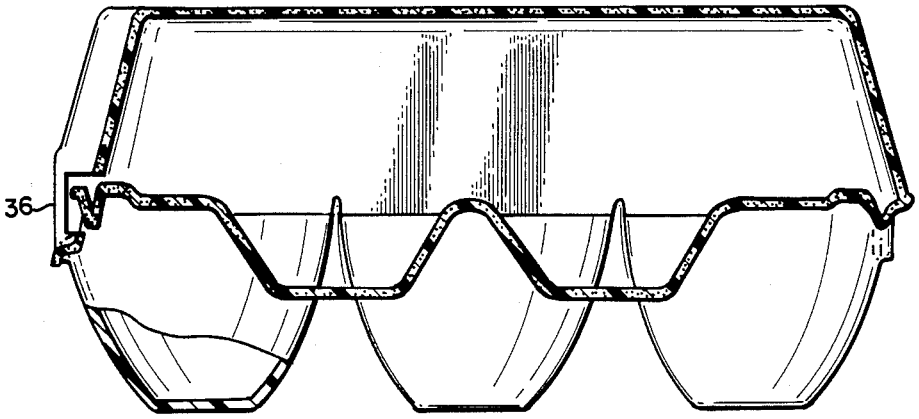
FIGS. 10A and 10B depict a carton with a latch formed only be a cover extension.
Figure 10B:
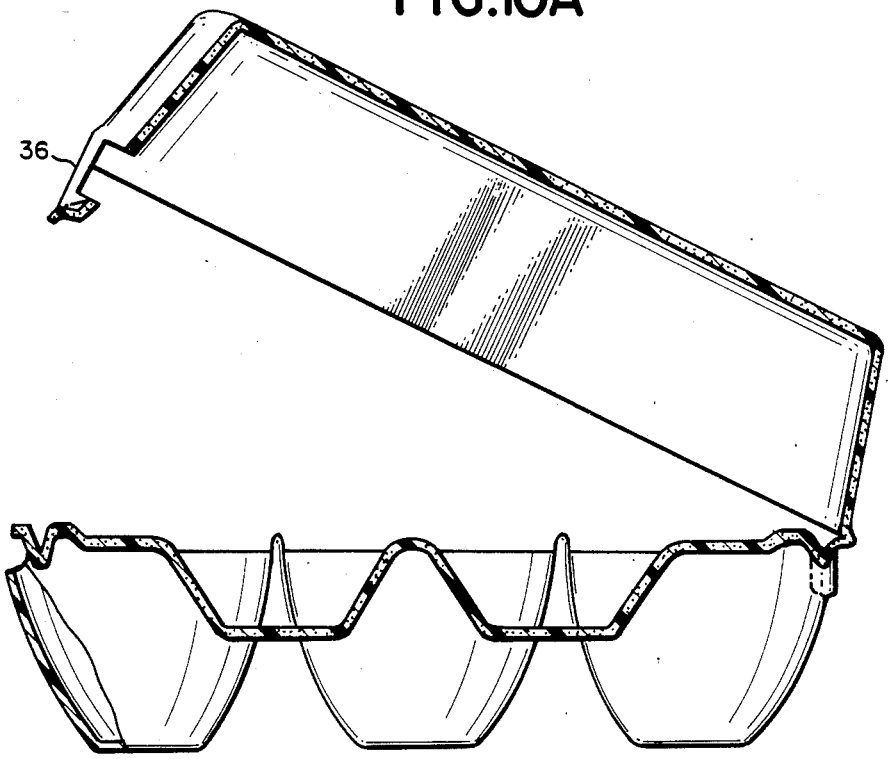

Another undesirable solution is shown in FIGS. 10A and 10B wherein the latch is formed by extending only the cover, as by the extension 36. Again, a severe stretching of the plastic beyond the sheet line is required to produce this configuration.

Only by slightly extending both the cell section and the cover in accordance with the present invention, can a suitable carton without a latch flap be produced by thermoforming.

The advantage of the present invention in permitting the use of existing packaging equipment can best be appreciated with reference to FIG. 4. In FIG. 4, the plan dimension marked "A" is 6" in the present practice of the invention. When the carton is in the open position, shown in FIG. 5, the plan dimension marked "B" is 12". The carton holder, the denesting machinery, filling paddles, and the like, in existing packaging equipment are such that a carton having these dimensions can be processed, whereas a carton with the added dimension of a latch flap could not be processed on this equipment.

While a particular embodiment of the invention has been shown and described, various modifications are within the true spirit and scope of the invention. The appended claims are, therefore, intended to cover all such modifications.

What is claimed is:

1. A process for the production of a thermoformed thermoplastic carton comprising:

providing a relatively flat oriented sheet of polystyrene foam having a sheet line;

preheating said sheet to at least its forming temperature;

thermoforming said preheated sheet by bringing together a male mold member and a female mold member to form said carton by:

forming a cell section from said plastic sheet to define a plurality of cells extending from the sheet line in one direction;

forming a dished cover resiliently hinged to the rear edge of said cell section, said cover being formed from said plastic sheet to define a front wall, a back wall, and end walls extending in said one direction from said sheet line and fixed to each other and to a top for said cover;

stretching said plastic sheet in the opposite direction from said sheet line to form an extension from said cell section along the front edge of said cell section; and forming complementary latching elements on said cover front wall and on said extension from said cell section.

2. The method recited in claim 1 further comprising:

forming a plurality of protrusions on said extension from said cell section.

3. The method recited in claim 1 further comprising:

shearing a hole in said front cover while thermoforming, the latching elements on said extension being formed to extend through a complementary one of the holes of said cover to latch said carton in the closed position.

4. The thermoplastic carton thermoformed by the process recited in claim 1.

5. A mold for the production of a thermoformed thermoplastic carton comprising:

a male mold member;

a female mold member;

means for closing said male and female mold members on a preheated flat sheet of polystyrene foam having a sheet line to produce a carton having a cover and a cell section from said sheet, said male mold member extending said cover and said cell section from said sheet line in one direction; and means in said mold members for stretching the front edge of said cell section in the opposite direction from said sheet line to form a cell section extension having mating elements of said latch thereon.

6. The mold recited in claim 5 further comprising:

means in said male and female mold members for forming a hinge between said cover and said cell section, and wherein said means for stretching the front end of said cell section comprises:

a former on said female mold member at the edge remote from, and parallel to, said means for forming a hinge, said former stretching the front edge of said cell section in said opposite direction upon closing.

* * * * *

UNITED STATES PATENT AND TRADEMARK OFFICE

CERTIFICATE OF CORRECTION

PATENT NO. : 4,625,907

DATED : December 2, 1986

INVENTOR(S) : Ray k. Mangla

It is certified that error appears in the above-identified patent and that said Letters Patent is hereby corrected as shown below:

The term of patent subsequent to September 16, 2003 has been disclaimed.

Signed and Sealed this

Eleventh Day of August, 1987

*Attest:*

DONALD J. QUIGG

*Attesting Officer*

*Commissioner of Patents and Trademarks*